US005234352A

United States Patent [19]

Bungo et al.

[11] Patent Number: 5,234,352

[45] Date of Patent: Aug. 10, 1993

[54] LOWER ENGAGED SEAL RIB CONFIGURATION

[75] Inventors: Edward M. Bungo, Cortland, Ohio; John M. Chupak, West Middlesex, Pa.

[73] Assignee: General Motors Corporation, Detroit, Mich.

[21] Appl. No.: 982,532

[22] Filed: Nov. 27, 1992

[51] Int. Cl.[5] ..... H01R 11/00
[52] U.S. Cl. ..... 439/282
[58] Field of Search ..... 439/271-283

[56] References Cited

U.S. PATENT DOCUMENTS

| | | | |
|---|---|---|---|
| 3,611,255 | 10/1971 | Shroyer | 439/282 |
| 3,880,487 | 4/1975 | Goodman et al. | 439/282 |
| 4,711,509 | 12/1987 | Cross et al. | 439/587 |
| 4,874,325 | 10/1989 | Bensing et al. | 439/272 |

*Primary Examiner*—Joseph H. McGlynn
*Attorney, Agent, or Firm*—William A. Schuetz

[57] ABSTRACT

An annular elastomeric seal for use with mating plug and socket connectors and having axially spaced sealing ribs which are tapered and skewed with respect to the axes of mating plug and socket connectors whereby the force required to connect the connectors together is reduced.

6 Claims, 2 Drawing Sheets

LOWER ENGAGED SEAL RIB CONFIGURATION

The present invention relates generally to electrical connectors and, more particularly, to mating electrical plug and socket connectors that have an interface annular elastomeric seal provided with tapered skewed sealing lips or ribs.

Mating electrical plug and socket connectors having an interface seal of elastomeric material are well known in the art. These interface seals have included an annular body that is mounted or biasingly retained on the plug portion of the electrical plug connector and with its trailing end adjacent or against a radially extending stop shoulder on the plug portion of the plug connector. These seals further included a plurality of axially spaced sealing lips or ribs that extended radially outwardly of the annular body and were perpendicular to the axis of the plug portion of the plug connector. These sealing ribs deflect into biased sealing engagement with an inner surface of a shroud of the mating electrical socket connector when the plug connector is plugged or inserted into the socket connector. Examples of these prior annular elastomeric seals are shown in U.S. Pat. Nos. 4,711,509; 4,874,325 and in co-pending patent application Ser. No. 857,131, filed Mar. 24, 1992, all of which are assigned to the same assignee as the present invention.

While these prior elastomeric seals have been successfully used in electrical connector applications, they do require the use of a certain amount of force to overcome their frictional resistance and resistance against the deflection when they are engaged by the shroud of the socket connector when the two connectors are being mated or connected together. The shroud of the socket connector engages the full area or annular extent of each sealing lip as it comes into contact therewith when being connected to the plug portion, since the sealing ribs extend perpendicular to the axis of the plug portion.

The present invention provides an annular elastomeric seal which differs from the seals previously used and described above in that the sealing ribs or lips are (1) tapered and (2) skewed with respect to the axis of the plug portion of the plug connector and the shroud of the socket connector. That is, the sealing ribs, which are peripherally continuous, lie in planes which form an acute included angle to planes extending perpendicular to the axis of the plug portion and the shroud. Preferably, only two axially spaced sealing ribs are used and they are skewed so that the acute included angle is approximately 10°. The sealing ribs are also tapered to have a thickness which progressively decreases from their base toward their free ends.

The advantages of the novel elastomeric seal of the present invention are that the shroud of the socket connector comes into contact with the sealing ribs over small areas at a time as the plug is being connected to the socket connector. This considerably reduces the force required to connect the two mating connectors together. This reduced force also lessens any tendency of the seal to bunch up against the radially extending stop shoulder on the plug connector. In addition, the force is further reduced as a result of the ribs being tapered as compared to untapered ribs.

The present invention further resides in various novel constructions and arrangement of parts, and further objects, novel characteristics and advantages of the present invention will be apparent to those skilled in the art to which it relates and from the following detailed description of the illustrated, preferred embodiment thereof made with reference to the accompanying drawings forming a part of this specification and in which similar reference numerals are employed to designate corresponding parts throughout the several views, and in which.

Figure 1:
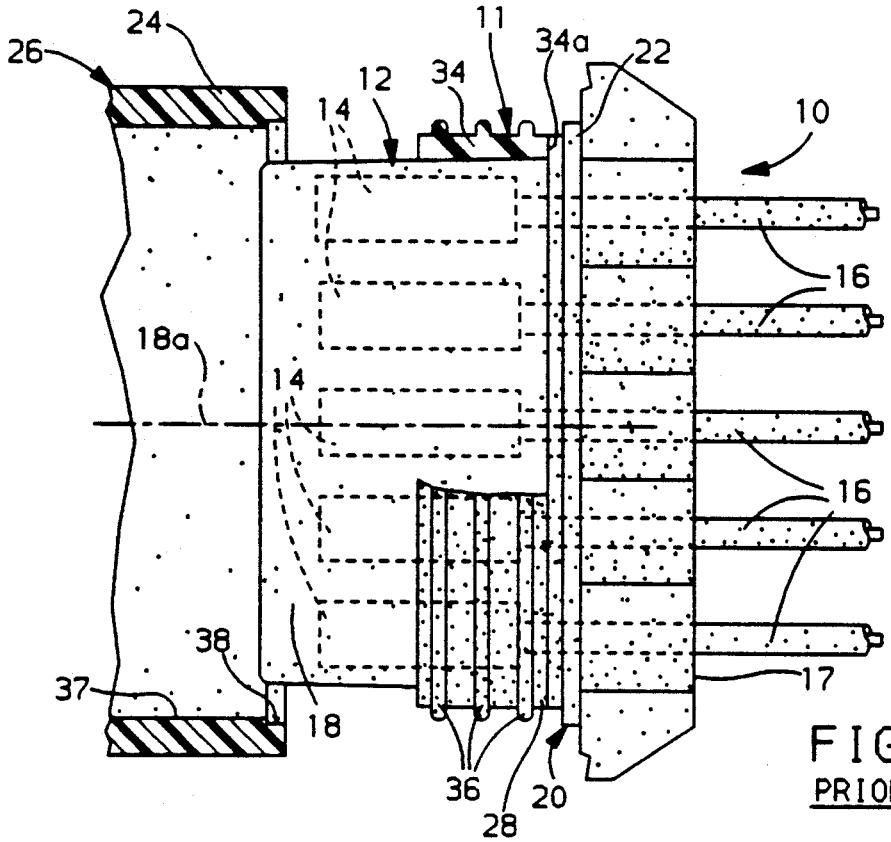
FIG. 1 PRIOR ART
FIG. 1 is a plan view of a prior art electrical plug connector having an annular elastomeric interface seal thereon.

FIG. 1 of the drawings shows a prior art electrical plug connector 10 with an annular elastomeric interface seal 11. The plug connector 10 comprises a connector body 12 of electrically insulating material, such as a suitable thermoplastic like nylon. The connector body 12 has a plurality of axially extending cavities (not shown) extending therethrough for housing a plurality of electrical terminals 14 that are illustrated schematically and that are attached to electric cables 16 that extend out of an axial or longitudinal end 17 of the connector body 12. The schematically illustrated electrical terminals 14 could be of any suitable or conventional construction and may be attached to the electric cables in the conventional manner using well know crimping techniques.

The plug connector body 12 had a generally rectangular plug portion 18 at its mating or opposite axial end. The plug portion 18 has a central axis **18*a* and extends rearwardly from its mating end to an integral medial annular flange 20**.

The medial annular flange 20 extends transversely or radially outwardly of the plug portion 18. The annular flange 20 has an outer portion 22 that serves as a pilot and as a stop for a generally rectangularly shaped shroud 24 of a mating electrical socket connector 26. The annular flange 20 also had a stop shoulder 28 of reduced height located forwardly of the outer portion 22 that forms a ledge or shoulder extending peripherally around the plug portion 18 of the connector body 12.

The electrical plug connector 10 further includes the elastomer interface seal 11. The seal 11 forms a seal between the plug portion 18 and the shroud 24 when the electrical plug connector 10 is plugged into the electrical socket connector 26. The elastomeric interface seal 11 comprises an annular generally rectangularly shaped body 34 of a given radial thickness. The annular body 34 is mounted or secured to the plug portion 18 by radially expanding the same and slipping it over the plug portion 18. The dimensions of the annular body 34 are such that when released it contracts to biasingly and sealingly engage the outer peripheral surface of the plug portion 18. The annular body 34 when positioned on the plug portion 18 has its trailing end **34*a* thereof in engagement with the stop shoulder 28 on the connector body 12**.

The elastomeric seal 11 also has a plurality of axially spaced, annular, flexible or deflectable sealing ribs or lips 36. The ribs 36 extend radially outwardly of the annular body 34, as shown in FIG. 1, and are disposed such that they lie in planes which are perpendicular to the axis 18*a* of the plug portion 18 of the connector body 12. The sealing ribs 36 when the plug connector 10 is inserted into the shroud 24 of the socket connector 26 are caused to be deflected by an annular inner surface 37 of the shroud 24 so that the sealing lips 36 biasingly engage the inner surface 37 of the shroud 24 when fully connected into the socket connector 26, which occurs when the outer end 38 of the shroud 24 abuts the shoulder 22, to provide a seal between the plug connector 10 and the socket connector 26.

It should be noted that in the prior art elastomeric seal 11 the entire annular side or area of the rib 36 is engaged by the shroud 24 as it passes over the ribs 36.

FIGS. 2-5 show an electrical plug connector 10 and a novel interface elastomeric seal 40 made in accordance with the provisions of the present invention. The plug connector 12 and socket connector 26 shown in FIGS. 2-5 are of an identical construction to that previously described with respect to the prior art plug connector 12 and socket connector 26 shown in FIG. 1 and therefore will not be described again and corresponding parts will be given the same reference numerals.

The difference between the plug and socket connector means of the present invention, as shown in FIGS. 2-5, from that previously described in connection with the prior art, as shown in FIG. 1, is that a different elastomeric interface seal 40 is employed. The elastomeric seal 40 is a generally rectangularly shaped annulus 41 of a given radial thickness. It has forward and trailing ends 40(*a*) and 40*b*, respectively, which are parallel and lie in planes which are perpendicular to the axis 18*a* of the plug portion 18 of the plug connector 10. The elastomeric seal 40 has only two annular or peripherally continuous axially spaced sealing ribs or lips 42. The sealing ribs 42 extend radially outwardly and are skewed with respect to the ends 40*a* and 40*b* of the seal 40. The sealing ribs 42 have a thickness as viewed in cross section, which progressively decreases, proceeding from their base 42*a* toward their rounded free ends 42*b* to define tapered forward and trailing sides 42*c* and 42*d*, respectively, which converge toward each other. The sides 42*c* and 42*d* of the ribs 42 preferably have a taper angle A of approximately 8.5° with respect to a perpendicular plane passing through the base 42*a* of the ribs 42.

Figure 2:
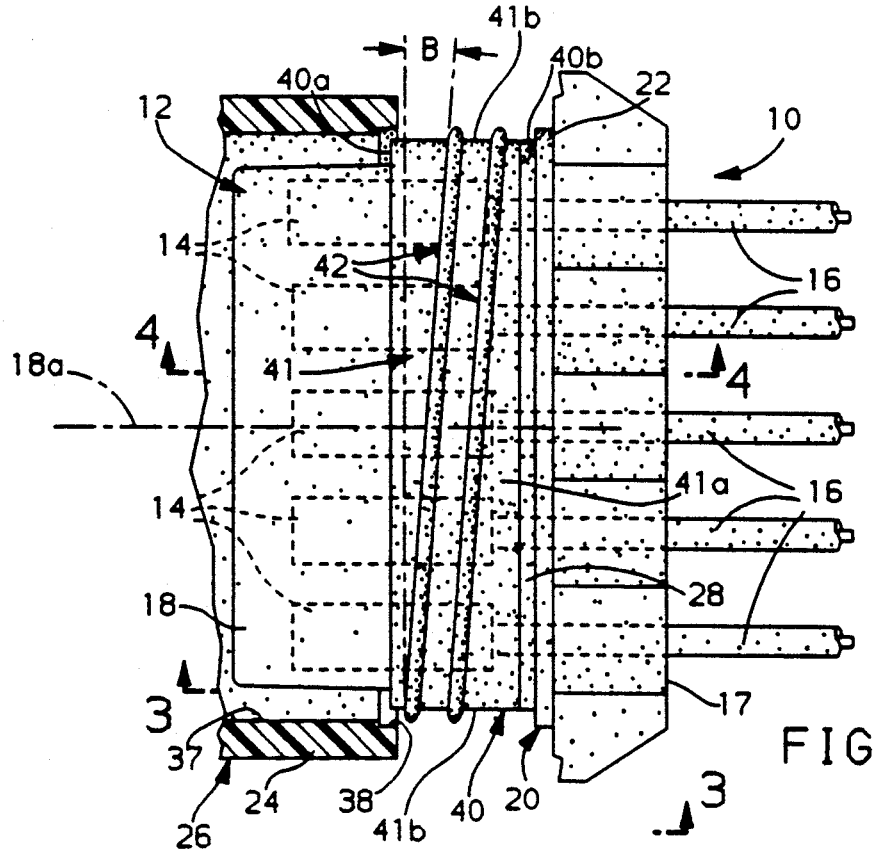
FIG. 2 is a plan view of an electrical plug connector having an annular elastomeric interface seal in accordance with the present invention and a fragmentary cross sectional view of a mating socket connector.
Figure 3:
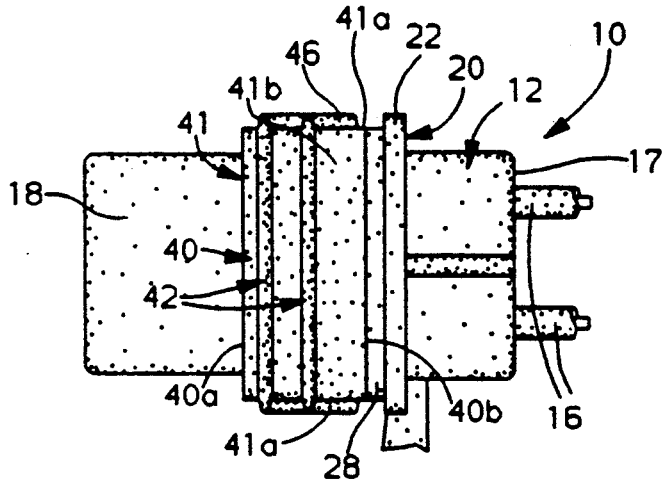
FIG. 3 is a side elevational view of the electrical plug connector and elastomeric seal shown in FIG. 2.
Figure 4:
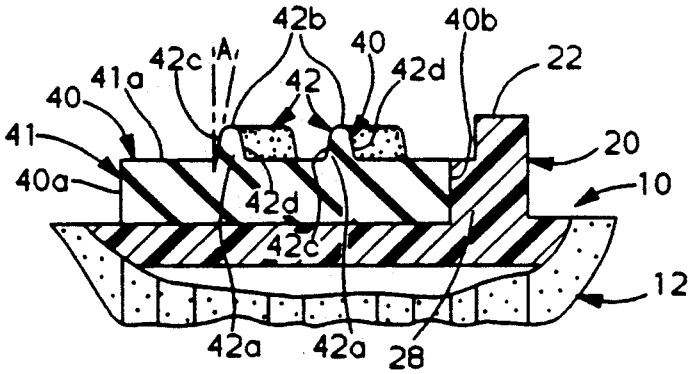
FIG. 4 is an enlarged fragmentary cross sectional view of part of the electrical plug connector of FIG. 2 and taken along the lines 4—4 thereof.

The skewed sealing ribs 42 lie in planes which form an acute included angle B with planes extending perpendicular to the axis 18*a* of the plug portion 18 of the connector body 12. The included angle B is less than 15° and preferably is approximately 10°. As can be seen from FIG. 2, the ribs 42 along the long sides 41*a* generally rectangular annulus 41 extend generally diagonally from the forward ends 40*a* toward the trailing ends 40*b* of the seal 40. The ribs 42 along the short sides 41*b* of the annulus 41, as shown in FIG. 3, are generally parallel to the trailing and leading ends 40*b* and 40*a*.

Figure 5:
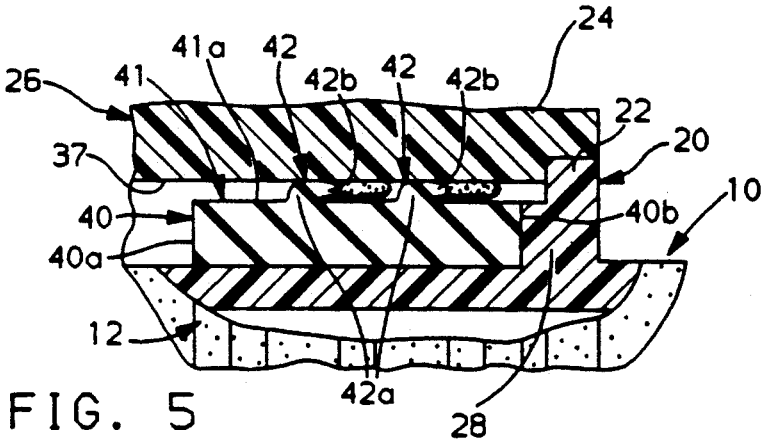
FIG. 5 is an enlarged fragmentary sectional view like that shown in FIG. 4, but showing the plug connector and elastomeric seal mated to its mating socket connector.

When the plug portion of the connector body 12 is inserted into the shroud 24 of the mating socket connector 26, the ribs 42 are deflected so as to biasingly engage the inner surface 37 on the shroud 24 to provide a seal between the connectors 10 and 26, as shown in FIG. 5.

When the mating socket connector 26 is fully connected to the plug connector 12, the shroud 24 abuttingly engages the radial shoulder of the outer portion 22 of connector body 12, as shown in FIG. 5.

It should be noted that when the plug portion 18 of the connector 10 is being inserted into the shroud 24 of the socket connector 26, the inner surface 37 of the shroud comes into contact with the sealing ribs 42 only over small areas at a time. This is in contrast with the prior art elastomeric sealing seal 11 shown in FIG. 1 in which the inner surface 37 of the shroud 24 engages over the full extent of each sealing lip as it comes into contact therewith. This reduced contact reduces the force required to connect the two mating connectors together. Also, the amount of force is reduced by employing tapered ribs 42, since they are more readily flexed or deflected than the constant thickness ribs 36 of the prior art seal 11 shown in FIG. 1. It has also been found that the use of two skewed and tapered sealing rings, as shown in FIG. 2, provides just as good a seal between the mating connectors as does the three sealing rib arrangement of the prior art, as shown in FIG. 1 The elimination of one of the ribs also reduces the amount of force required during connection of the plug and socket connectors 10 and 12. Furthermore, the reduced force also lessens any tendency of the seal 40 to bunch up against the stop shoulder 28 on the plug connector 12. Any reduction in the force required to connect the two connectors together makes it easier for an assembler who continuously connects such connectors together.

Although the illustrated embodiment hereof has been described in great detail, it should be apparent that certain modifications, changes and adaptations may be made in the illustrated embodiment, and that it is intended to cover all such modifications, changes and adaptations which come within the spirit of the present invention.

The embodiments of the invention in which an exclusive property or privilege is claimed are defined as follows:

1. An electrical connector comprising a connector body having an axis and having a plug portion adjacent one axial end that extends rearwardly to an integral flange that extends radially outwardly of the plug portion, a mating socket connector having a shroud for receiving said plug portion of said connector body, an elastomeric interface seal for forming a seal between the plug portion and an internal surface of the shroud of the mating electrical socket connector when the plug portion of said body is plugged into the electrical socket connector, said elastomeric seal being mounted on said plug portion adjacent said integral flange, said elastomeric interface seal having an annular body that has a plurality of peripherally continuous axially spaced flexible sealing lips that extend outwardly of the annular body an extent such that they are deflected and biasingly engage the inner surface of said shroud when the plug portion is plugged into said electrical socket connector, the improvement being that said sealing lips lie in planes that form an acute included angle with planes that extend perpendicular to said axis so that said shroud of said socket connector comes into contact with said sealing lips over small areas at a time as the plug connector is being plugged into the socket connector to reduce the force required to connect the two mating connectors together.

2. An electrical connector, as defined in claim 1, and wherein said acute included angle is less than 15°.

3. An electrical connector comprising a connector body having an axis and having a plug portion adjacent one axial end that extends rearwardly to an integral flange that extends radially outwardly of the plug portion, a mating socket connector having a shroud for receiving said plug portion of said connector body, an elastomeric interface seal for forming a seal between the plug portion and an internal surface of the shroud of the mating electrical socket connector when the plug portion of said body is plugged into the electrical socket connector, said elastomeric seal being mounted on said plug portion adjacent said integral flange, said elastomeric interface seal having an annular body that has at least two peripherally continuous axially spaced flexible sealing lips that extend outwardly of the annular body an extent such that they are deflected and biasingly engage the inner surface of said shroud when the plug portion is plugged into said electrical socket connector, the improvement being that said sealing lips lie in planes that form acute included angles of approximately 10° with planes that extend perpendicular to said axis so that said shroud of said socket connector comes into contact with said sealing lips over small areas at a time as the plug connector is being plugged into the socket connector to reduce the force required to connect the two mating connectors together.

4. An electrical connector, as defined in claim 3, and wherein said plug portion, said shroud and said elastomeric seal are generally rectangular in shape and have long and short sides, said annular elastomeric seal having opposite ends which are perpendicular to said axis, and wherein said sealing lips along their portions lying along the short sides thereof are disposed parallel to said ends of said annular elastomeric seal and along their portions lying along the long sides thereof are disposed generally diagonally between said ends of said seal.

5. An electrical connector, as defined in claim 4, and wherein said sealing lips have a thickness which progressively decreases proceeding from their base toward their free ends to define tapered leading and trailing sides whose planes passing an angle through their base and extending perpendicular to axis of the plug portion is approximately 8.5°.

6. An electrical connector comprising a connector body having an axis and having a plug portion adjacent one axial end that extends rearwardly to an integral flange that extends radially outwardly of the plug portion, a mating socket connector having a shroud for receiving said plug portion of said connector body, an elastomeric interface seal for forming a seal between the plug portion and an internal surface of the shroud of the mating electrical socket connector when the plug portion of said body is plugged into the electrical socket connector, said elastomeric seal being mounted on said plug portion adjacent said integral flange, said elastomeric interface seal having an annular body that has a plurality of peripherally continuous axially spaced flexible sealing lips that extend outwardly of the annular body an extent such that they are deflected and biasingly engage the inner surface of said shroud when the plug portion is plugged into said electrical socket connector, the improvement being that said sealing lips have leading and trailing sides which converge toward each other from their base toward their free ends to define a tapered sealing lip, said sealing lips lying in planes that form an acute included angle with planes that extend perpendicular to said axis so that said shroud of said socket connector comes into contact with said sealing lips over small areas at a time as the plug connector is being plugged into the socket connector to reduce the force required to connect the two mating connectors together.

* * * * *